US005615628A

United States Patent [19]

Tajima et al.

[11] Patent Number: 5,615,628

[45] Date of Patent: Apr. 1, 1997

[54] SEWING MACHINE WITH SEPARATE DRIVE SOURCES FOR COMPONENTS THEREOF

[75] Inventors: Ikuo Tajima; Kenji Suzuki, both of Kasugai, Japan

[73] Assignee: Tokai Kogyo Mishin Kabushiki Kaisha, Japan

[21] Appl. No.: 639,826

[22] Filed: Apr. 29, 1996

[30] Foreign Application Priority Data

May 12, 1995 [JP] Japan ..... 7-114743

[51] Int. Cl.[6] ..... D05B 35/06; D05B 69/12; D05C 7/08

[52] U.S. Cl. ..... 112/220; 112/99; 112/157

[58] Field of Search ..... 112/220, 80.4–80.43, 112/157, 443, 452, 459, 271, 221, 235, 236, 237, 339, 98–100

[56] References Cited

U.S. PATENT DOCUMENTS 523,522 7/1894 Haas et al. ..... 112/99 X 4,461,226 7/1984 Tajima ..... 112/98

4,513,672 4/1985 Tajima ..... 112/100

5,088,429 2/1992 Kanegae ..... 112/220 X

*Primary Examiner*—Ismael Izaguirre

*Attorney, Agent, or Firm*—Dennison, Meserole, Pollack & Scheiner

[57] ABSTRACT

A sewing machine has a sewing head which includes a needle bar drive mechanism for vertically reciprocally moving a needle bar, a presser foot drive mechanism operable to vertically move a presser foot in synchronism with the vertical movement of the needle bar, a direction control mechanism operable to pivot the presser foot about the needle bar for controlling a direction of the presser foot to a predetermined direction, and a guide member drive mechanism operable to reciprocally pivot a guide member. The guide member is adapted to guide a cord-like material to be sewn on a work. The presser foot drive mechanism, the direction control mechanism and the guide member drive mechanism have a first drive source, a second drive source and a third drive source, respectively, provided independently of each other.

12 Claims, 11 Drawing Sheets

SEWING MACHINE WITH SEPARATE DRIVE SOURCES FOR COMPONENTS THEREOF

BACKGROUND OF THE INVENTION

1. Field of the Invention

The present invention relates to a sewing machine, and particularly to a sewing machine which is operable to form zigzag stitches on a work fabric by a cord-like material.

2. Description of the Prior Art

A conventional sewing machine includes a presser foot having a predetermined configuration and positioned on the same axis as a needle bar or includes a presser foot holder which serves as a presser foot by itself. A guide member is provided for guiding a cord-like material such as a cord and a tape which is adapted to form stitches on a work fabric. The sewing machine includes a vertical drive mechanism for vertically moving the presser foot holder in synchronous with vertical movement of the needle bar, a pivotal control mechanism for pivoting the presser foot holder about the axis of the needle bar, and a guide member drive mechanism for reciprocally pivoting the guide member. These mechanisms are designed to mechanically convert the rotation of a main shaft into their intended movements.

With the conventional sewing machine, however, the vertical drive mechanism and the pivotal control mechanism for the presser foot holder and the guide member drive mechanism for the guide member cannot be controlled to be actuated in desired motions for various kinds of sewing since conditions these mechanisms utilize the main shaft as their drive source. Therefore, the conventional sewing machine cannot be operated to cope with various sewing operations.

SUMMARY OF THE INVENTION

It is, accordingly, an object of the present invention to provide a sewing machine in which a vertical movement of a presser foot holder, a direction of the presser foot holder and a movement of a guide member for a cord-like material can be controlled independently of each other.

It is another object of the present invention to provide such a sewing machine which can cope with various sewing conditions.

According to the present invention, there is provided a a sewing machine comprising a sewing head, the sewing head including:

- a needle bar drive mechanism for vertically reciprocally moving a needle bar;
- a presser foot drive mechanism operable to vertically move a presser foot in synchronism with the vertical movement of the needle bar;
- a direction control mechanism operable to pivot the presser foot about the needle bar for controlling a direction of the presser foot to a predetermined direction; and
- a guide member drive mechanism operable to reciprocally pivot a guide member adapted to guide a cord-like material to be sewn on a work; and
- the presser foot drive mechanism, the direction control mechanism and the guide member drive mechanism having a first drive source, a second drive source and a third drive source, respectively, provided independently of each other.

With this construction, the presser foot drive mechanism, the direction control mechanism and the guide member drive mechanism can be controlled independently of each other, so that these mechanisms can perform any desired motions.

The invention will become more fully apparent from the claims and the description as it proceeds in connection with the drawings.

DETAILED DESCRIPTION OF THE PREFERRED EMBODIMENT

An embodiment of the present invention will now be described with reference to the drawings.

Figure 1:
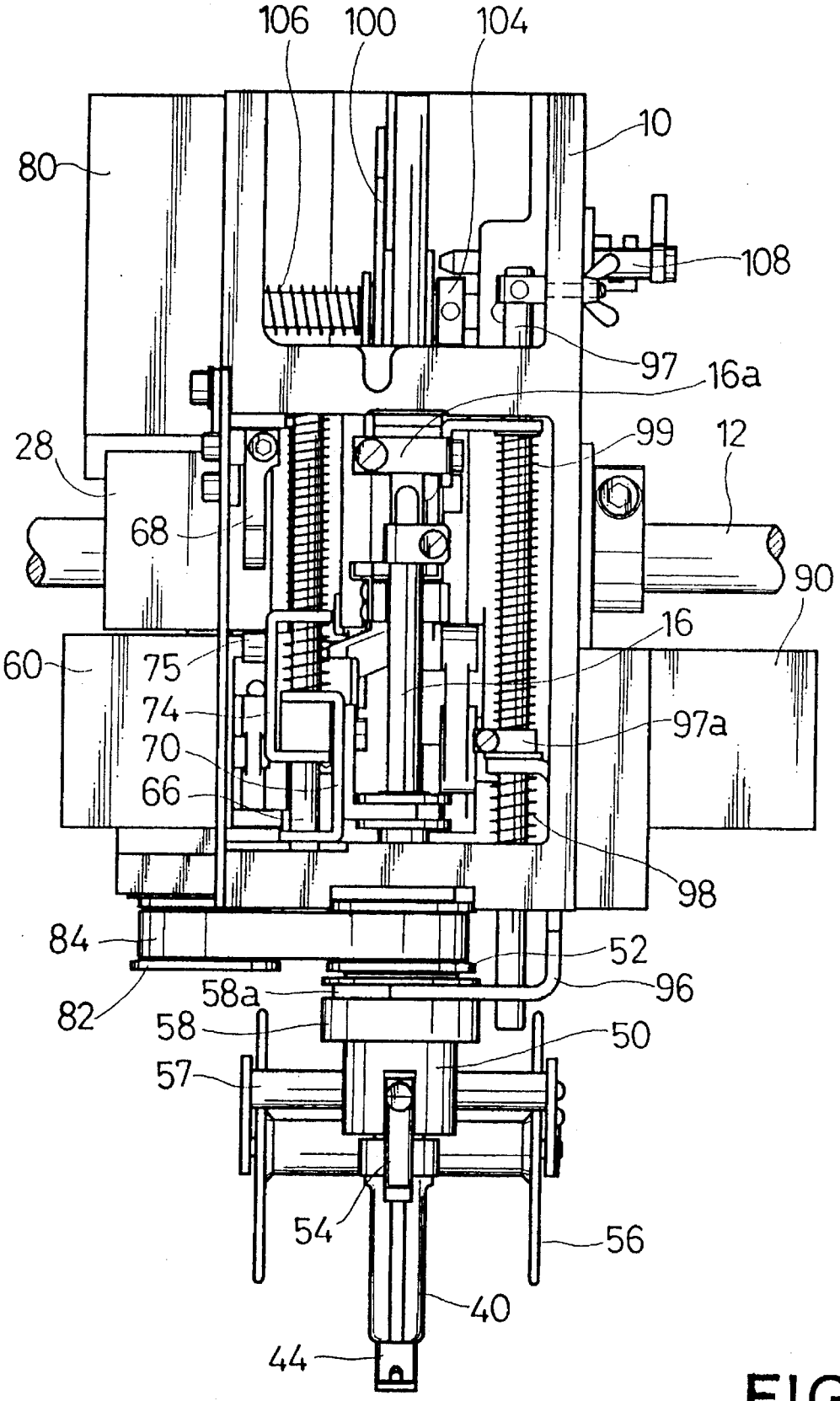
FIG. 1 is a front view of a sewing head of a sewing machine according to an embodiment of the present invention.
Figure 2:
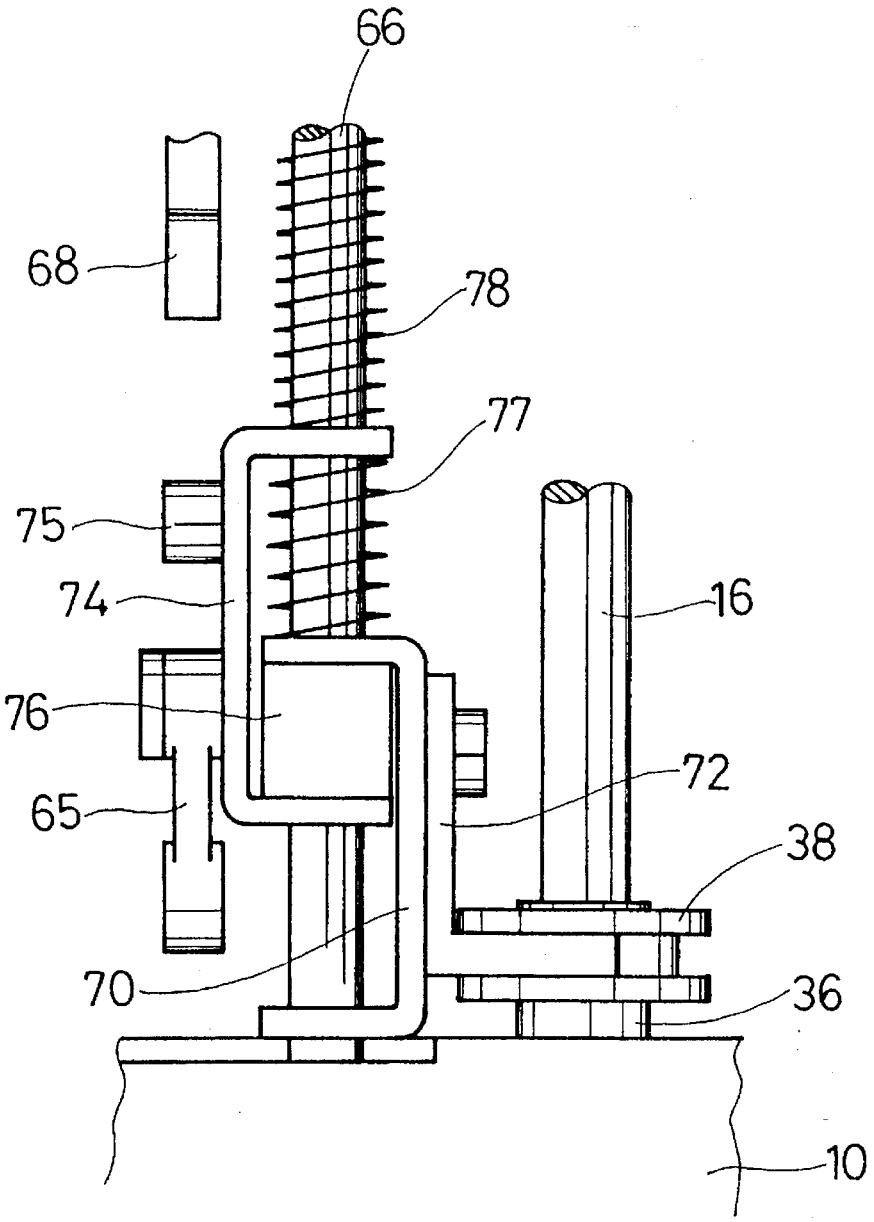
FIG. 2 is an enlarged view of some parts shown in FIG. 1.
Figure 3:
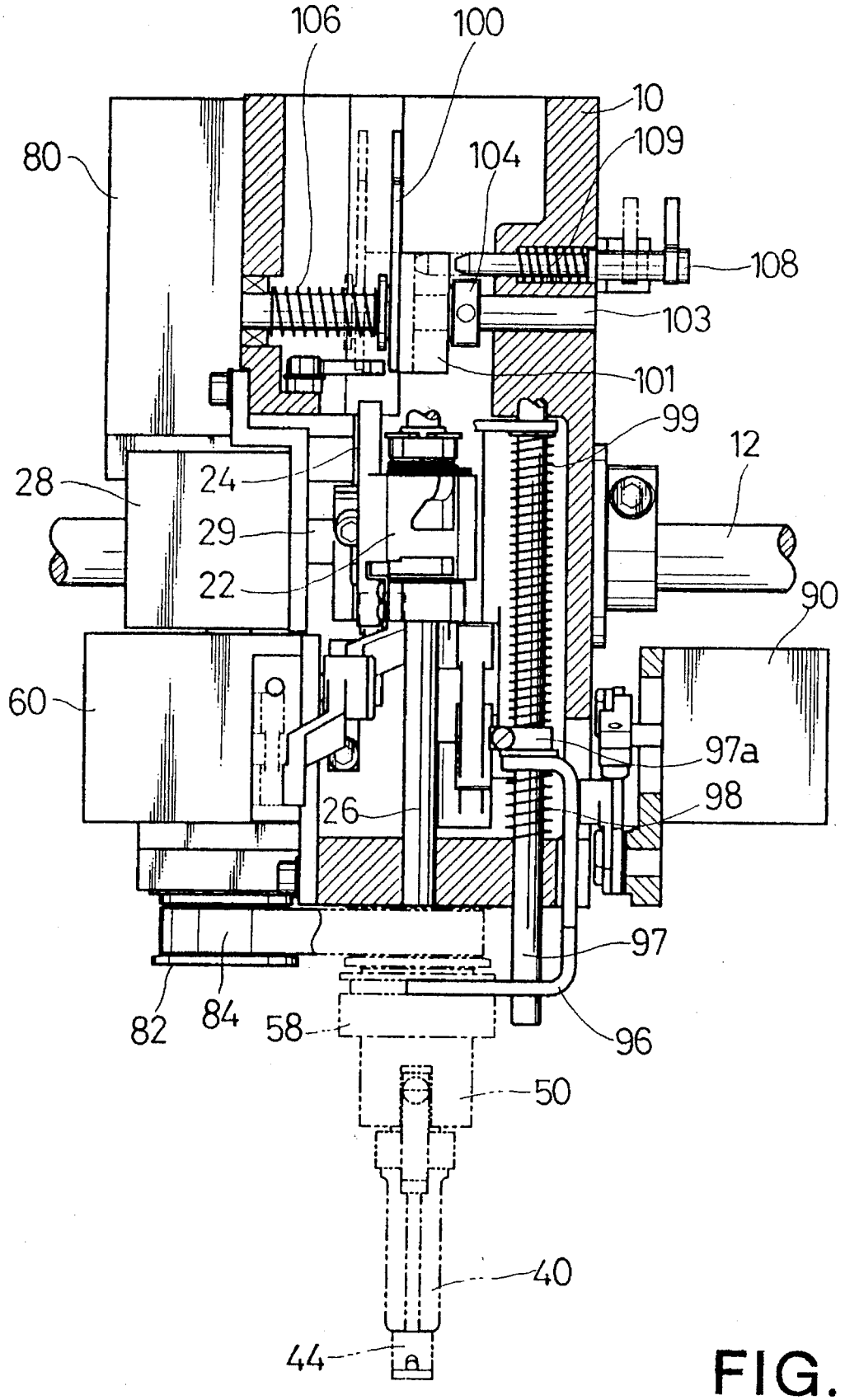
FIG. 3 is a front view similar to FIG. 1 but showing the sewing head with a part broken away.
Figure 4:
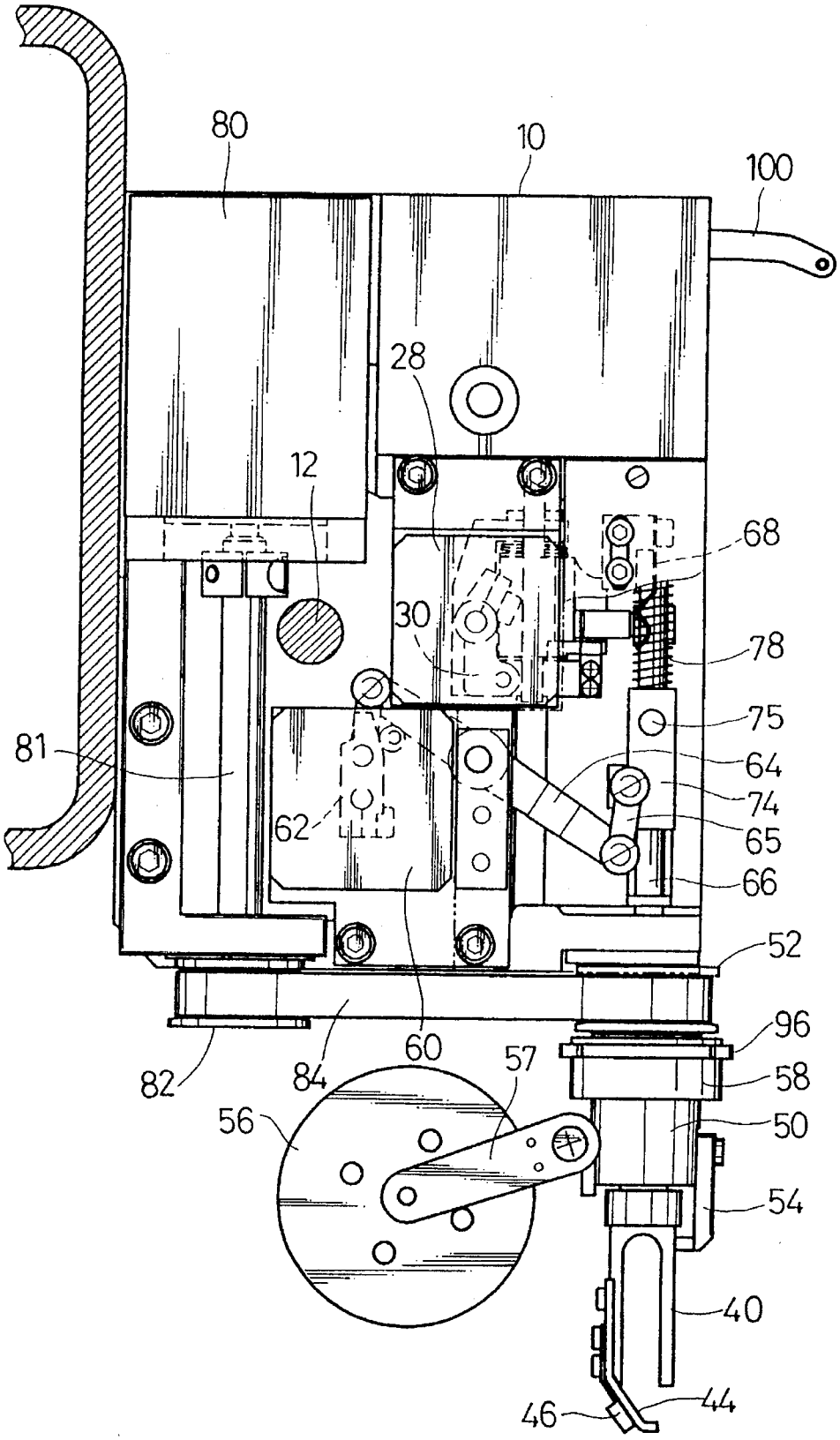
FIG. 4 is a left side view of the sewing head.

Referring to FIG. 1, there is shown a front view of a sewing head of a sewing machine. An enlarged view of some parts of the sewing head is shown in FIG. 2. The front view of the sewing head is also shown in FIG. 3 with a part broken away. A left side view of the sewing head is shown in FIG. 4. As shown in FIGS. 1 to 4, a main shaft 12 of the sewing machine extends through a machine frame or machine arm 10 which has a left side outer wall on which are mounted a motor 28 for driving a jumping control mechanism of a needle bar 16, a motor 60 for driving a presser foot drive mechanism for vertically moving a presser foot holder 40, and a motor 80 for driving a direction control mechanism for controlling the direction of the presser foot 40. Further, the machine arm 10 has a right side outer wall on which is mounted a motor 90 for driving a guide member drive mechanism which has a zigzag stitch arm 116 (a guide member 118) to be swingably moved to form zigzag stitches.

Figure 5:
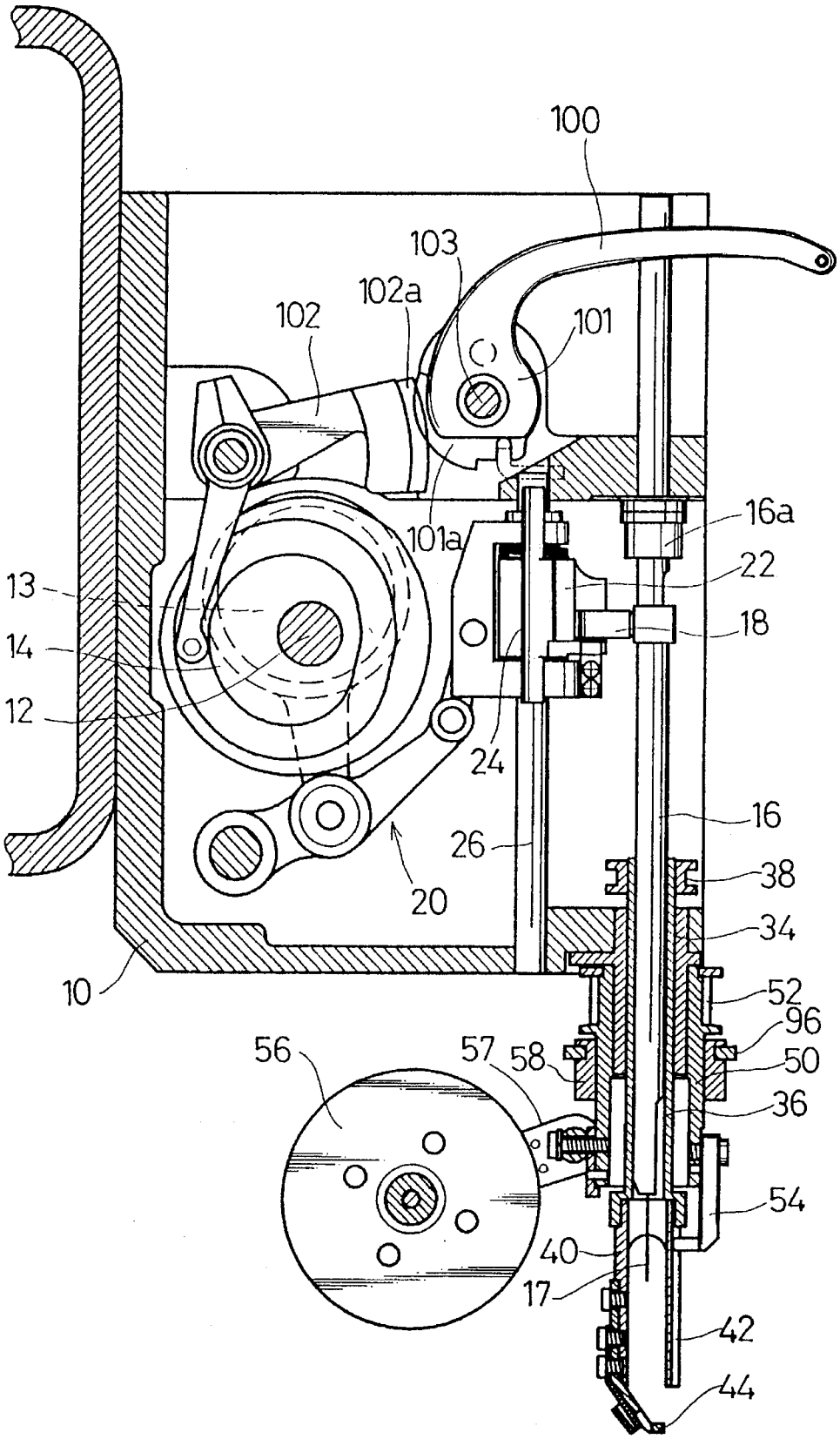
FIG. 5 is a left side view similar to FIG. 4 but showing the sewing head with a part broken away.

As will be apparent from FIG. 5 which shows a vertical sectional view of the sewing head, the needle bar 16 is vertically movably supported by the machine arm 10. A sewing needle 17 is mounted on a lower end of the needle bar 16. A needle bar support 18 is secured to the middle portion of the needle bar 16. The needle bar 16 is operated by a needle bar drive mechanism 20 which is driven by the rotation of the main shaft 12 as a drive source. The needle bar drive mechanism 20 serves to convert the rotation of a needle bar cam 13 secured to the main shaft 12 into a vertical movement of a vertical drive member 22 relative to a guide shaft 26 which is supported vertically by the machine arm 10. The needle bar drive mechanism 20 also serves to transmit the vertical movement of the vertical drive member 22 to the needle bar 16 through the needle bar holder 18.

The vertical drive member 22 is vertically movably and rotatably supported by the guide shaft 26. An engaging surface 24 is formed on one lateral side of the vertical drive member 22 and has a predetermined vertical length.

As shown in FIG. 5, a thread take-up lever 100 has a boss 101 which is rotatably and axially slidably supported by a take-up lever shaft 103. The take-up lever shaft 103 is mounted on the machine arm 10 and extends in parallel to the main shaft 12. A take-up lever drive arm 102 cooperates with a take-up lever cam 14 which is secured to the main shaft 12 for rotation therewith, so that the thread take-up lever 100 is repeatedly reciprocally pivoted around the axis of the take-up lever shaft 103 by the take-up lever drive arm 102.

As shown in FIG. 3, a spring 106 is fitted on the takeup lever shaft 103 and is interposed between the boss 101 of the thread take-up lever 100 and the machine arm 10, so that the thread take-up lever 100 is normally biased to the right as viewed in FIG. 3 by the biasing force of the spring 106 and that the boss 101 is in abutment on a stopper 104 which is secured to the take-up lever shaft 103. In this state, a gear 101*a* of the boss 101 and a gear 102*a* of the take-up lever drive arm 102 are in engagement with each other, so that the drive force of the take-up lever drive arm 102 is transmitted to the thread take-up lever 100.

A push pin 108 is slidably inserted into a right side wall of the machine arm 10 and is normally biased outwardly by a spring 109 which is fitted on the push pin 108 and which is disposed within the right side wall. When the push pin 108 is pushed into the right side wall as shown by chain lines in FIG. 3, the thread take-up lever 100 is moved leftwardly along the take-up lever shaft 103. As the result, the gear 101a of the boss 101 is disengaged from the gear 102*a* of the take-up lever drive arm 102, so that the transmission of drive force from the take-up lever drive arm 102 to the thread take-up lever 100 is interrupted. When this occurs, the thread take-up lever 100 is held in a predetermined rotational position, and the push pin 108 is held in a position shown by the chain lines.

Figure 6:
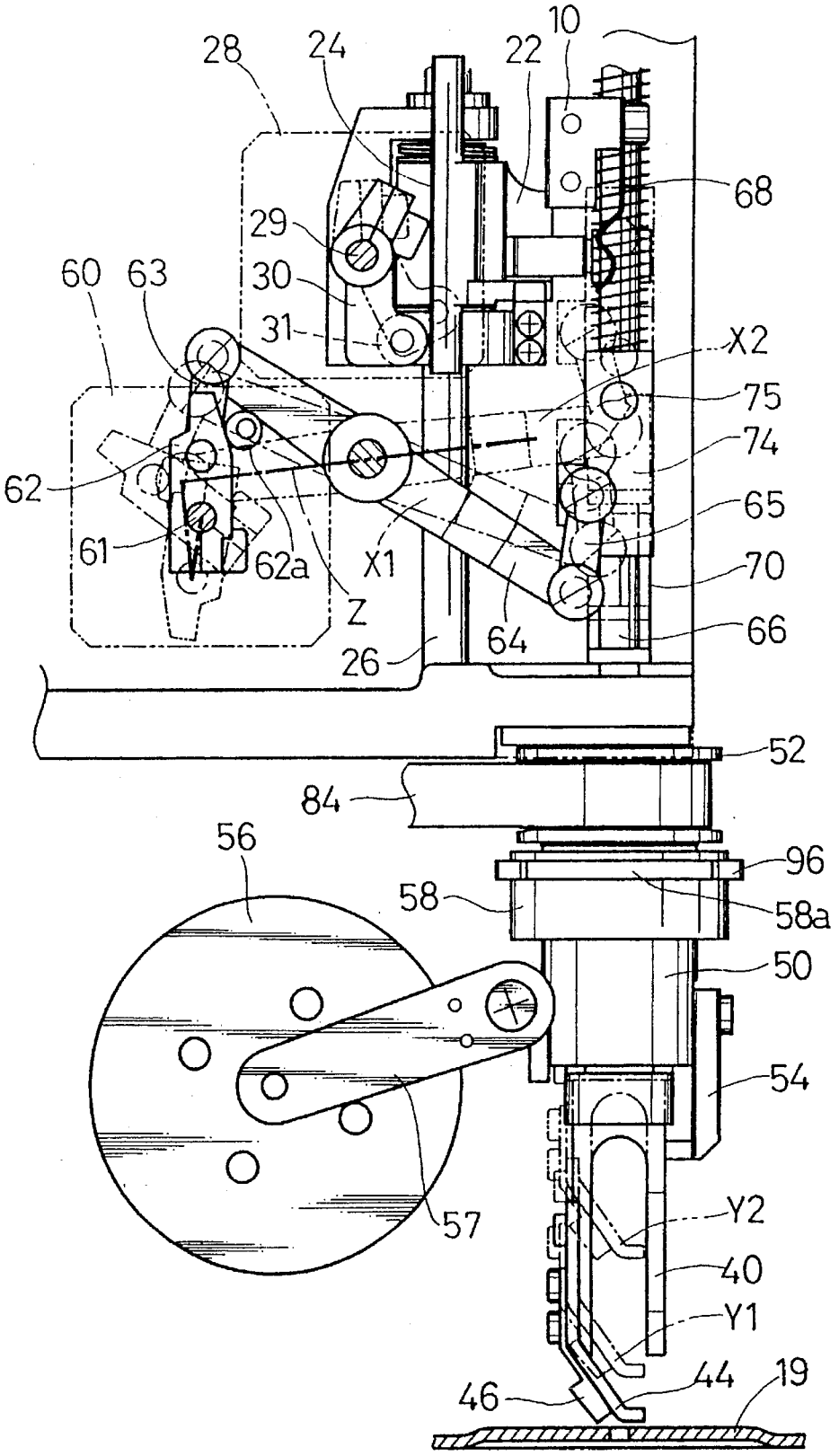
FIG. 6 is an enlarged view of some parts shown in FIG. 4.

The jumping control mechanism will now be explained. As shown in FIG. 6 which is an enlarged view of a part of FIG. 4, a drive arm 30 is fixed to an output shaft 29 of the motor 28 for controlling the jumping movement of the needle bar 16. The motor 28 is driven based on a jumping signal which is outputted from a controller (not shown), so that the drive arm 30 is pivoted from a position shown by solid lines in FIG. 6 to a position shown by chain lines.

Thus, when the needle bar 16 reaches around its upper dead center, the drive arm 30 is pivoted to the position shown by chain lines in FIG. 6, so that the engaging surface 24 of the vertical drive member 22 of the needle bar drive mechanism 20 is pushed by a roller 31 which is mounted on one end of the drive arm 30. The vertical drive member 22 is therefore pivoted around the axis of the guide shaft 26 to release the needle bar holder 18 of the needle bar 16, so that the needle bar 16 is brought into a jumping state. The jumping state is continuously maintained as long as the drive arm 30 is held in the rotational position shown by chain lines in FIG. 6. The vertical length of the engaging surface 24 of the vertical drive member 22 is determined such that the engaging surface 24 confronts the roller 31 of the drive arm 30 all over the vertical stroke movement of the needle bar 26.

Figure 7:
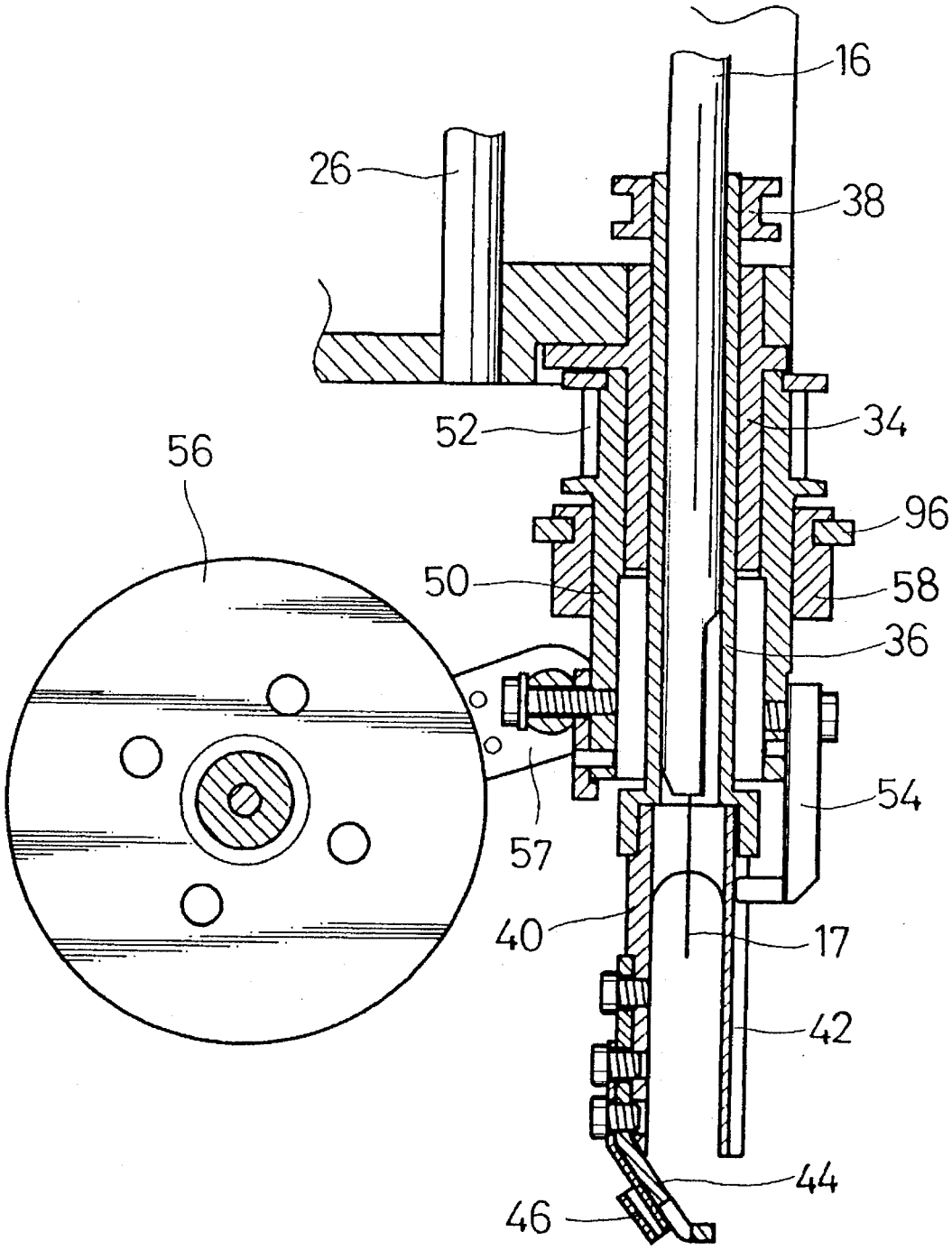
FIG. 7 is an enlarged view of some parts shown in FIG. 5.

As shown in FIG. 7 which is a sectional view of a part of FIG. 6, a support cylinder 36 is slidably inserted into a fixed sleeve 34 which is secured to a lower portion of the is machine arm 10, so that the support cylinder 36 is vertically movable relative to the needle bar 16 and rotatable around the axis of the needle bar 16. A ring 38 is secured to the upper end of the support cylinder 36. The presser foot holder 40 is connected to the lower end of the support cylinder 36.

As will be seen from FIG. 6, the presser foot holder 40 has a fork-like configuration having two fingers one of which has an outer surface having a vertically elongated key recess 42 (see FIG. 7) formed therein. The presser foot 44 is detachably mounted on the lower end of the other of these fingers. A guide 46 is fixed to the presser foot 44 for guiding a cord-like material supplied from a bobbin 56 to a position above and adjacent a throat plate 19 shown in FIG. 6.

As shown in FIGS. 5 and 7, a rotary cylinder 50 is fitted on the fixed sleeve 34. The rotary cylinder 50 is rotatable around its axis but is not movable in the vertical direction relative to the fixed sleeve 34. A pulley 52 is formed on the outer surface of the upper end of the rotary cylinder 50. A key 54 is fixed to the lower end of the rotary cylinder 50 and is in engagement with the key recess 42 of the presser foot holder 40. A bobbin bracket 57 is mounted on the outer surface of the rotary cylinder 50 for rotatably supporting the bobbin 56 on which the cord-like material selected among various kinds of cord-like materials is wound.

A drive ring 58 is rotatably and vertically movably fitted on the rotary cylinder 50. An annular groove 58*a* is formed on the outer surface of the drive ring 58.

The presser foot drive mechanism for vertically driving the presser foot holder 40 will now be explained.

As shown in FIG. 2, a drive arm 72 has a fork-like end which is in engagement with the ring 38 of the support cylinder 36, so that the drive arm 72 is operable to transmit its vertical movement to the support cylinder 36. The drive arm 72 is mounted on a vertically movable member 70 which is vertically movably supported on a guide shaft 66 mounted vertically on the machine arm 10, so that the drive arm 72 is adjustable with respect to its lower dead center position. A vertically movable base 74 is vertically movably supported on the guide shaft 66, and the vertically movable member 70 is supported by the vertically movable base 74 by means of a block 76. A spring 77 is fitted on the guide shaft 66 and is interposed between the vertically movable member 70 and the vertically movable base 74, so that the vertically movable member 70 is biased in a direction (downward direction) to be pressed on the block 76.

A spring 78 is fitted on the guide shaft 66 in a position upwardly of the vertically movable base 74 and normally biases the vertically movable base 74 downwardly. Here, the biasing force of the spring 78 is determined to be smaller than the biasing force of the spring 77 (approximately one third the biasing force of the spring 77).

The motor 60 serves as a drive source of the presser foot drive mechanism and has an outputs shaft 61 to which a drive lever 62 is secured as shown in FIGS. 4 and 6. The drive lever 62 has one end connected to one end of a pivot arm 64 by means of a link member 63. The pivot arm 64 is pivotally supported by the machine arm 10 and has the other end connected to the vertically movable base 74 by means of a link member 65.

When the motor 60 is driven to reciprocally pivot the pivot arm 64 between a position shown by solid lines in FIG. 6 and a position X1 indicated by chain lines, the vertically movable member 70 as well as the vertically movable base 74 is moved vertically along the guide shaft 66. As a result, the support cylinder 36 is moved vertically together with the presser foot holder 40 by the drive arm 72 between a lower dead center position shown by solid lines in FIG. 6 and an upper dead center position Y1 indicated by chain lines.

When the presser foot holder 40 (or the presser foot 44) is in its lower dead center shown by solid lines in FIG. 6, the drive lever 62 is in abutment on a stopper 62*a*. Further, the controller controls the motor 60 such that the supply of current for driving the motor 60 is temporary interrupted each time after the presser foot holder 40 has performed one stroke movement to move the presser foot 44 from and to its lower dead center via its upper dead center. As the result, the drive lever 62 is pivoted by the biasing force of the spring 78 to a position to abut on the stopper 62*a*, Thus, even if the synchronism between the rotation of the motor 60 and the vertical movement of the is presser foot 44 has been lost, the presser foot 44 reliably moved to its suitable lower dead center to correct deviation of the lower dead center given by the motor 60 from the suitable lower dead center after each stroke movement.

As shown in FIGS. 1, 2, 4 and 6, a pin 75 is fixed to the vertically movable base 74, and a retainer member 68 made of leaf spring is fixed to one side surface of the machine arm 10 on the side of the pin 75. After the sewing operation has been finished, the motor 60 is driven to pivot the pivot arm 64 to a position X2 shown by chain lines in FIG. 6, so that the pin 75 is brought to engage the retainer member 68. Therefore, the presser foot holder 40 (or the presser foot 44) is held in a non-operative position Y2 indicated by chain lines when the current for driving the motor 60 has been interrupted after the pivotal movement of the pivot arm 64.

When the presser foot 44 is in the non-operative position, the link mechanism constituted by the output shaft 61 of the motor 60, the drive lever 62, the link member 63 and the pivot arm 64 is free to be actuated as indicated by chain lines Z in FIG. 6 by a force applied from a driven side of the link mechanism. Therefore, even if the motor 60 has not been driven for some reason or other when the sewing head is to be driven, as the needle bar 16 is moved downwardly by the driving force of the main shaft 12, a block 16*a* secured to the needle bar 16 as shown in FIGS. 1 and 5 is brought to abut on the drive arm 72, so that the pin 57 is disengaged from the retainer member 68 and that the link mechanism is forced to be actuated. The presser foot holder 40 (or the presser foot 44) is therefore moved downwardly in an interlocking manner with the needle bar 16, so that no trouble is caused to damage the parts of the sewing head.

The direction control mechanism for controlling the direction of the presser foot holder 40 (the presser foot 44) will now be explained.

The motor 80 serves as a drive source of the direction control mechanism and has an output shaft 81 to which a drive pulley 82 is secured in a position below and adjacent the machine arm 10. A timing belt 84 is passed between the drive pulley 82 and the pulley 52 of the rotary cylinder 50, so that the rotary cylinder 84 is reciprocally rotated when the motor 80 is driven and that the direction of the presser foot 44 as well as the presser foot holder 40 is controlled through the key member 54.

The guide member drive mechanism for driving the guide member 118 of the zigzag stitch arm 116 will now be explained.

As shown in FIGS. 1 and 3, a drive arm 96 has a forklike end which is in engagement with the annular groove 58*a* formed on the outer surface of the drive ring 58, so that the vertical movement of the drive arm 96 is transmitted to the drive ring 58. The drive arm 96 is vertically movably supported on a guide shaft 97. The guide shaft 97 is the mounted vertically on the machine arm 10 such that is vertical position relative to the machine arm 10 adjustable and that the guide shaft 97 can be fixed in the adjusted vertical position.

A spring 98 is fitted on the guide shaft 97 and is interposed between the drive arm 96 and the machine arm 10, so that the spring 98 normally biases the drive arm 96 in a direction (upward direction) to be pressed on a stopper 97*a* which is secured to the guide shaft 97. A spring 99 is fitted on the guide shaft 97 in a position above the stopper 97*a* and normally biases the needle bar 16 toward its upper dead center by means of a connecting member 16*b* which connects the guide shaft 87 and the needle bar 16.

Figure 8:
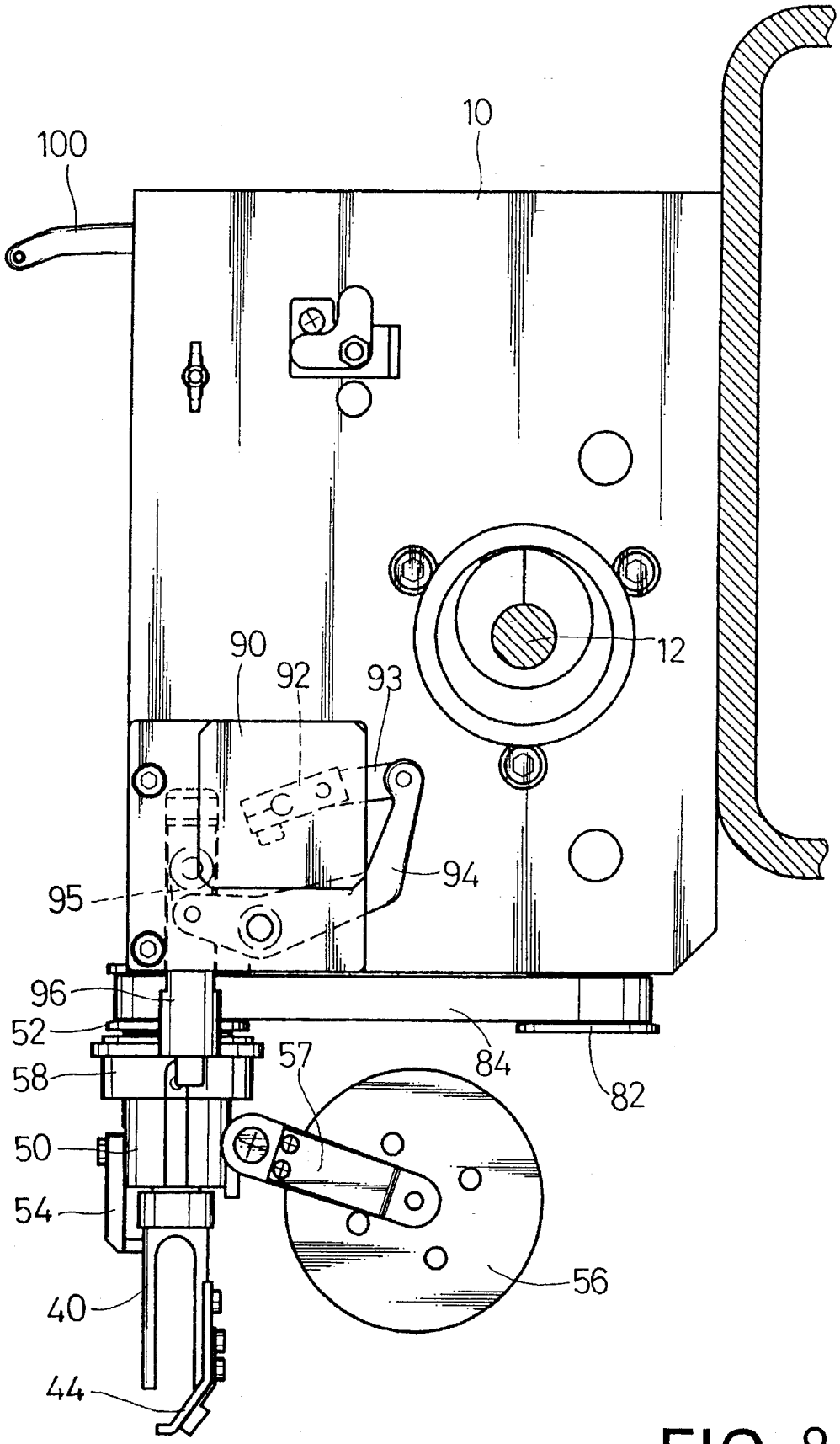
FIG. 8 is a right side view of the sewing head.
Figure 9:
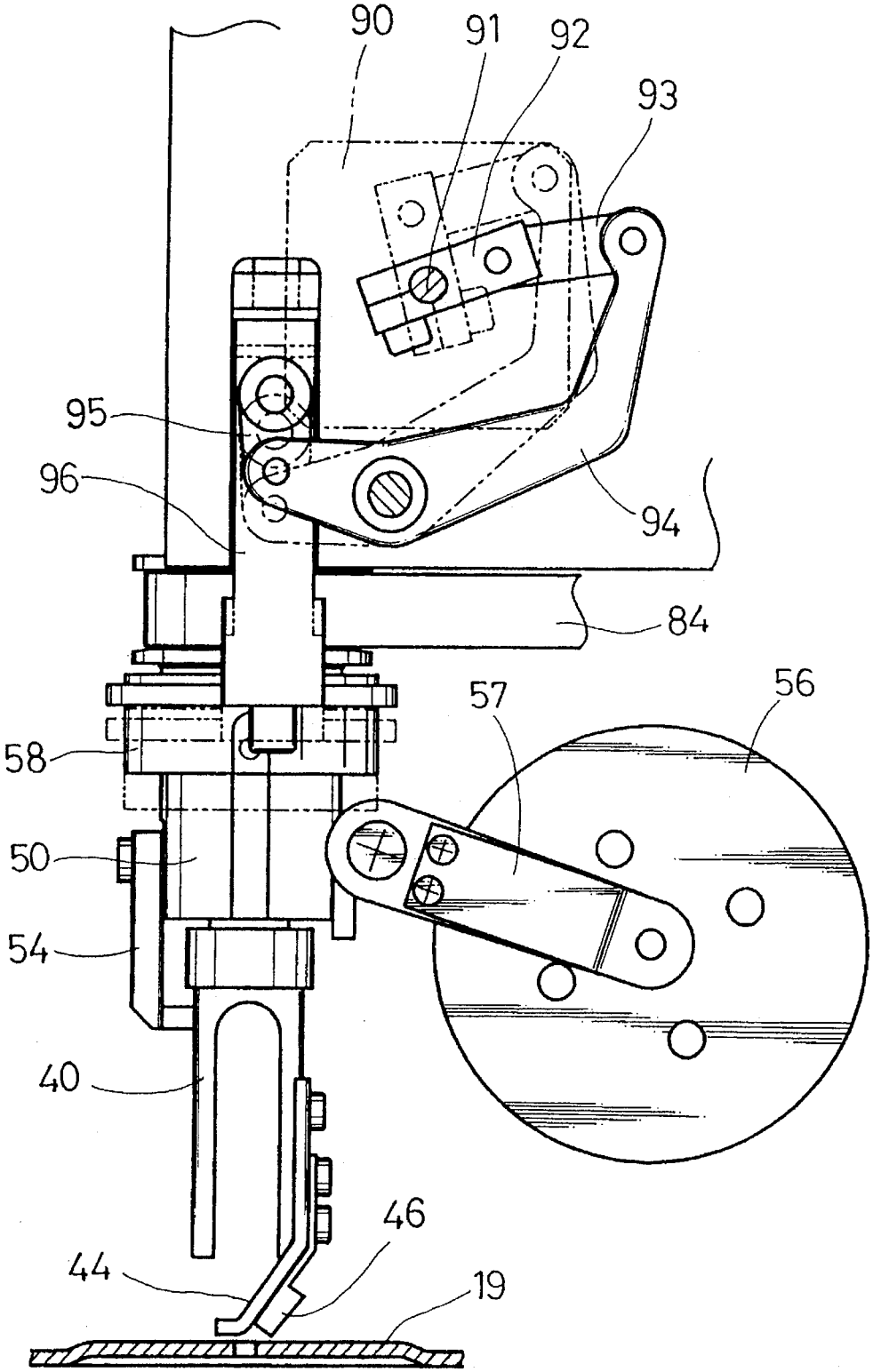
FIG. 9 is an enlarged view of some parts shown in FIG. 8.

FIG. 8 is a right side view of the sewing head, and FIG. 9 is an enlarged view of the essential parts of FIG. 8. As will be seen from FIGS. 8 and 9, the motor 90 which serves as a drive source of the guide member drive mechanism has an output shaft 91 to which a drive lever 92 is secured. The drive lever 92 has one end connected to a pivotal arm 94 via a link member 93. The pivotal arm 94 is pivotally supported by the machine arm 10. The drive lever 92 has the other end connected to a drive arm 96 via a link member 95.

When the motor 90 is driven to reciprocally pivot the pivotal arm 94 between a position shown by solid lines and a position shown by chain lines in FIG. 9, the drive arm 96 is so vertically reciprocally moved along the guide shaft 97, in that the drive ring 58 is vertically reciprocally moved arm an interlocking manner with the movement of the drive 96.

Figure 10:
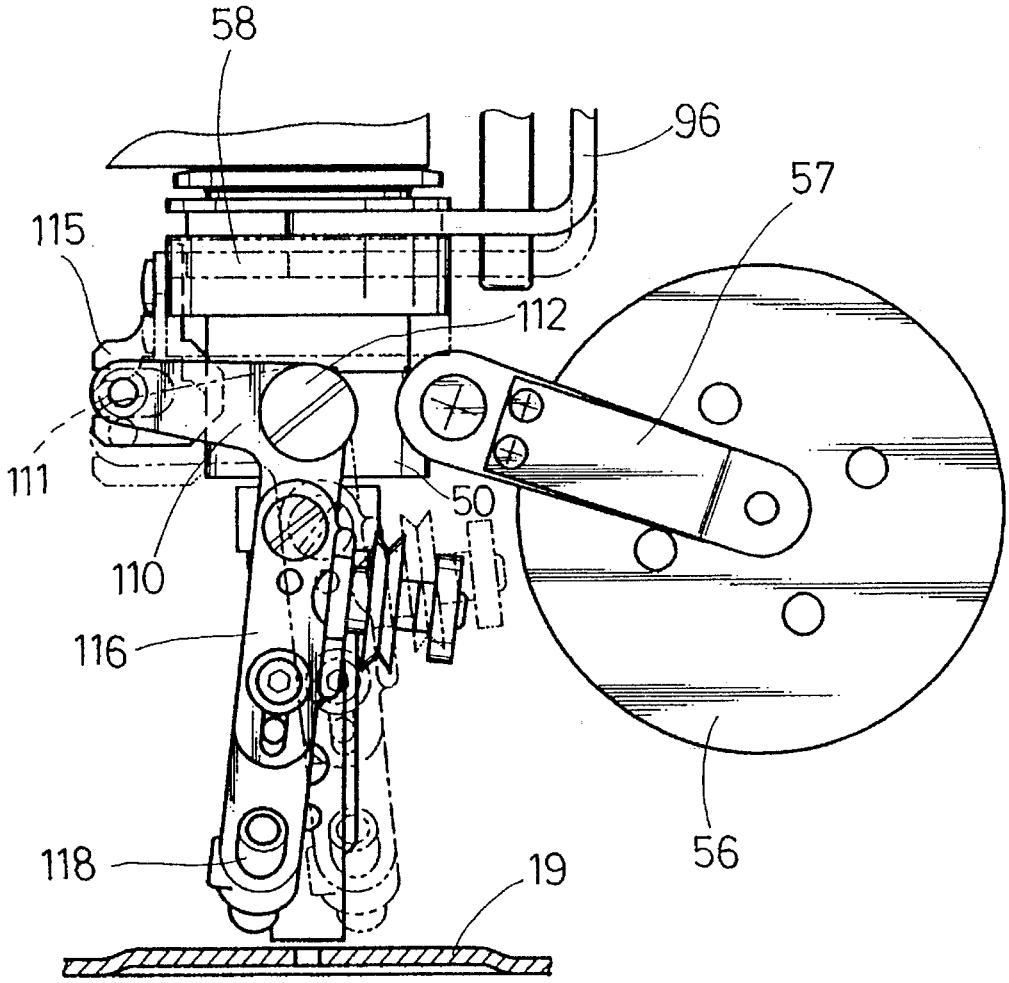
FIG. 10 is an explanatory view showing the operation for forming zigzag stitches.
Figure 11:
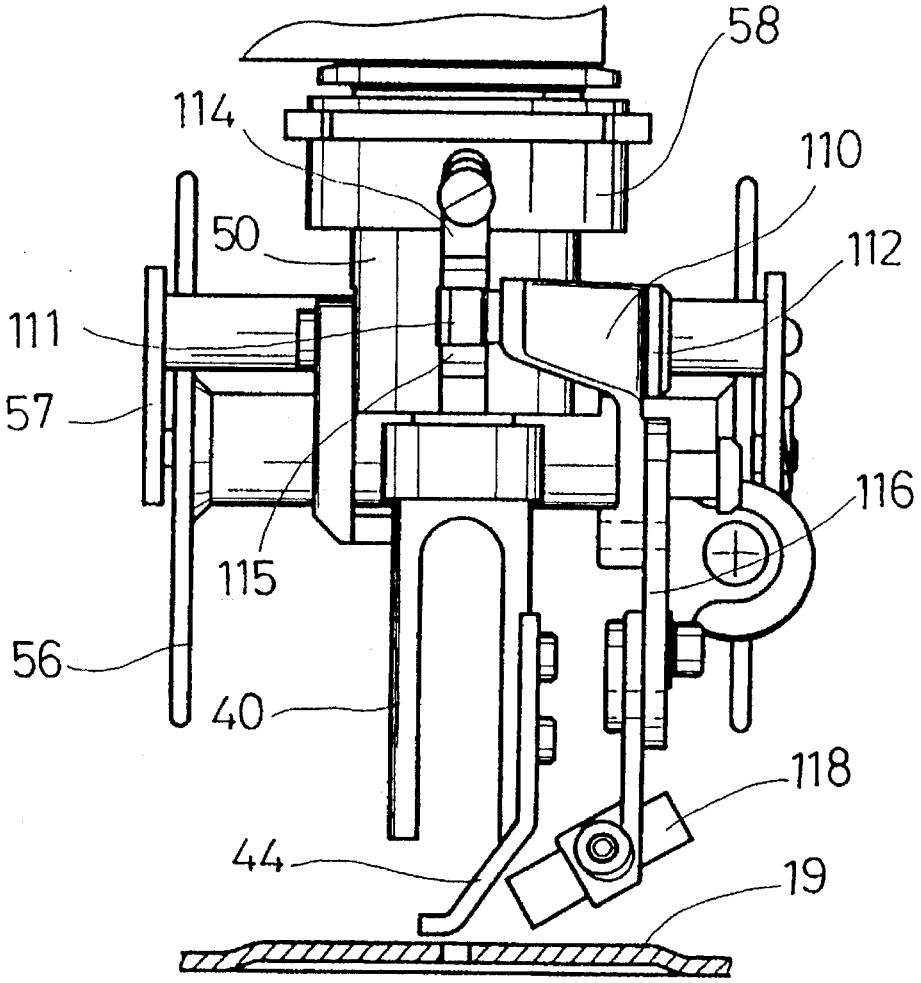
FIG. 11 is a left side view of FIG. 10.

FIGS. 10 and 11 show the operation for forming zigzag stitches. As shown in FIGS. 10 and 11, a bell crank 110 is pivotally mounted on an outer periphery of the rotary cylinder 50 by means of a pin 112. The bell crank 110 has one end which extends substantially horizontally from the mounting position of the pin 112 and which has a roller 111 mounted thereon. The bell crank 110 has a downward extension on which the zigzag stitch arm 116 is mounted. The guide 118 member has a tubular configuration to provide a guide for the cord-like material and is secured to the zigzag stitch arm 116.

On the other hand, an engaging member 114 is mounted on the drive ring 58 and has a fork-like portion 115 which is in engagement with the roller 111 of the bell crank 110, so that the bell crank 110 is reciprocally pivoted together with the zigzag stitch arm 116 and the guide member 118 about the axis of the pin 112 to provide a swinging movement of the zigzag stitch arm 116 and the guide member 118.

When the supply of current to the motor 90 has been interrupted, the drive arm 96 is moved to abut on the stopper 97*a* of the guide shaft 97 by the biasing force of the spring 98 and is held in position (see FIGS. 1 and 3). Thus, the zigzag stitch arm 116 is held in position shown by solid lines in FIG. 10. In addition, the vertical position of the guide shaft 97 relative to the machine arm 10 is adjustable. Thus, with the adjustment of the guide shaft 97 and with the adjustment of the rotational angle of the motor 90, the rotational angle (the angle of zigzag movement) of the zigzag stitch arm 116 can be varied according to the thickness or the width of the cord-like material.

The operation of the above embodiment will now be explained.

As the main shaft 12 is rotated, the needle bar 15 is vertically reciprocally moved, and the thread take-up lever 100 is reciprocally pivoted about the axis of the take-up lever shaft 103. When the jumping signal is outputted from the controller, the motor 28 is driven to rotate the vertical drive member 22 about the axis of the guide shaft 26, so that the needle bar 16 is brought into the jumping state. Since the rotation of the vertical drive member 22 is performed with its engaging surface 24 pressed by the roller 31 of the arm 30, collision sounds which may be produced when the jumping signal has been outputted (when the needle bar 16 is around its upper dead center) can be reduced.

On the other hand, the presser foot 44 is moved vertically by the vertically movable base 74 and the vertically movable member 70 which are moved when the motor 60 is driven. When the synchronism between the rotation of the motor 60 and the vertical movement of the presser foot 44 has been lost due to overload to the motor 60 or any other reason, the presser foot 44 is moved downwardly to its suitable lower dead center after each stroke movement, so that the loss of synchronism can be corrected. When the presser foot 44 cannot reach the suitable lower dead center due to interruption by any substance, the spring 77 interposed between the vertically movable member 70 and the vertically movable base 74 is compressed, so that any impact force applied to the presser foot can be reduced.

If the sewing machine is adapted to form stitches by the cord-like material on a work fabric to be sewn by supplying the cord-like material, which is wound around the bobbin 56, to a position below the sewing needle 17, the motor 80 is driven to pivot the presser foot 40 about the axis of the needle bar 16, so that the direction of the presser foot 44 as well as the guide member 46 for the cord-like material is controlled such that the bobbin 56 is always positioned on the front side in the stitch forming direction.

When the sewing machine is adapted to form the zigzag stitches as described with reference to FIGS. 10 and 11, the motor 90 is driven to reciprocally vertically move the drive ring 58, so that the zigzag stitch arm 116 is reciprocally pivoted (swingably moved) together with the guide member 118 for the cord-like material.

When the sewing head of this embodiment is adapted to a multi-head sewing machine having a plurality of such sewing heads, and when some of the sewing heads are to be operated to perform sewing operations while the remaining sewing heads are not to be operated, the controller controls each of the remaining sewing heads in the following manner: The needle bar 16 is continuously held in the jumping state, and the push pin 108 is operated to interrupt transmission of movement of the take-up lever drive arm 102 to the thread take-up lever 100. At this time, the motor 60 for vertical movement of the presser foot 44, the motor 80 for controlling the direction of the presser foot 44, and the motor 90 for reciprocal movement of the guide member 118 of the zigzag stitch arm 116 are stopped. Thus, by virtue of the drive system incorporating the motors 60, 80 and 90, it is not necessary to incorporate a clutch mechanism and its associated mechanism for each sewing head for controlling the same, so that the construction of the sewing machine is simplified.

In addition, the vertical movement of the presser foot 44, the control of the direction of the presser foot 44, and the reciprocal movement of the guide member 118 are separately performed by respective motors 60, 80 and 90, the amount of control or the control timing for these operations can be determined independently for each sewing head. Further, since only the main shaft 12 extends throughout the sewing head, the sewing machine can be easily assembled, and a maintenance work can be easily performed even if such a work requires to remove any shafts extending throughout the sewing head.

Although, in the above embodiment, the presser foot 44 is mounted on the presser foot holder 40, the presser foot holder 40 may have a substantially cylindrical configuration for serving as a presser foot by itself.

While the invention has been described with reference to a preferred embodiment thereof, it is to be understood that modifications or variations may be easily made without departing from the spirit of this invention which is defined by the appended claims.

What is claimed is:

1. A sewing machine comprising a sewing head, said sewing head including:

a needle bar drive mechanism for vertically reciprocally moving a needle bar;

a presser foot drive mechanism operable to vertically move a presser foot in synchronism with the vertical movement of said needle bar;

a direction control mechanism operable to pivot said presser foot about said needle bar for controlling a direction of said presser foot to a predetermined direction; and a guide member drive mechanism operable to reciprocally pivot a guide member adapted to guide a cord-like material to be sewn on a work; and said presser foot drive mechanism, said direction control mechanism and said guide member drive mechanism having a first drive source, a second drive source and a third drive source, respectively, provided independently of each other.

2. The sewing machine as defined in claim 1 wherein said needle bar drive mechanism includes a vertical drive member driven by a fourth drive source provided independently of said first to third drive sources, said vertical drive member being vertically movable along a guide shaft mounted on said sewing head and being pivotable about said guide shaft between an operable position to transmit its vertical movement to said needle bar and a non-operable position to disconnect the same movement, and wherein said sewing head further includes a needle bar jumping mechanism having a fifth drive source for pivoting said vertical drive member between said operable position and said non-operable position.

3. The sewing machine as defined in claim 1 wherein said presser foot drive mechanism includes:

a support member vertically movable along said needle bar and having said presser foot mounted thereon;

a link mechanism for connecting between said first drive source and said support member;

a spring for normally biasing said support member in such a direction that said presser foot is moved toward its lower dead center;

a stopper adapted to substantially abut on a part of said link mechanism when said presser foot is at its suitable lower dead center; and a controller for controlling said first drive source such that said first drive source is temporary stopped each time after said presser foot has been driven to perform one stroke movement from and to its lower dead center via its upper dead center, so that said presser foot is moved to said suitable lower dead center by the biasing force of said spring when the lower dead center given by said first drive source is different from said suitable lower dead center.

4. The sewing machine as defined in claim 3 wherein said presser foot drive mechanism further includes a vertically movable member connected between said support member and said link mechanism, said vertically movable member being movable along a second guide shaft, wherein said support member is connected to said vertically movable member to vertically move together with said vertically movable member, and wherein said spring biases said support member through said vertically movable member.

5. The sewing machine as defined in claim 3 wherein said controller is operable to drive said first drive source to move said presser foot to a waiting position upwardly of the upper dead center, and wherein retainer means is provided for releasably holding said presser foot in said waiting position.

6. The sewing machine as defined in claim 5 wherein releasing means is provided for acting on said retainer means to release said presser foot when said needle bar is lowered to a predetermined position in case that said first drive source has accidentally not been driven.

7. The sewing machine as defined in claim 1 wherein said direction control mechanism includes a rotary member and a power transmission mechanism, said rotary member being rotatable about the axis of said needle bar and movable relative to said needle bar in an axial direction of said needle bar, and said power transmission mechanism being connected between said rotary member and said second drive source.

8. The sewing machine as define in claim 1 wherein a bobbin adapted for winding therearound the cord-like material is supported on said rotary member.

9. The sewing machine as defined in claim 8 wherein said guide member drive mechanism includes a drive member driven by said third drive source to move vertically in the axial direction of said needle bar, a zigzag stitch arm having said guide member mounted thereon, and a motion conversion mechanism for converting the vertical movement of said drive member into a swinging movement of said zigzag stitch arm, and wherein said zigzag stitch arm is pivotable relative to said rotary member.

10. The sewing machine as defined in claim 1 wherein said guide member drive mechanism includes a drive member driven by said third drive source to move vertically in the axial direction of said needle bar, a zigzag stitch arm having said guide member mounted thereon, and a motion conversion mechanism for converting the vertical movement of said drive member into a swinging movement of said zigzag stitch arm.

11. The sewing machine as defined in claim 9 wherein said drive member is vertically movably supported by a third guide shaft mounted on said sewing head, wherein said motion conversion mechanism includes a link mechanism connected between said drive member and said third drive source for converting the drive force of said third drive source into vertical movement of said drive member, and wherein a second spring is provided for normally biasing said drive member toward a second stopper mounted on said third guide shaft, so that said drive member is held in a position to abut on said second stopper when said third drive source has been stopped.

12. The sewing machine as defined in claim 1 wherein the sewing machine includes a plurality of said sewing heads.

* * * * *